US008353138B2

(12) United States Patent
Sigmund et al.

(10) Patent No.: US 8,353,138 B2
(45) Date of Patent: Jan. 15, 2013

(54) WINDOW FRAME WITH HIDDEN WEEP

(75) Inventors: John L. Sigmund, Gig Harbor, WA (US); Melvin L. Saunders, Auburn, WA (US); Eric A. Baczuk, Puyallup, WA (US)

(73) Assignee: Milgard Manufacturing Inc., Tacoma, WA (US)

( * ) Notice: Subject to any disclaimer, the term of this patent is extended or adjusted under 35 U.S.C. 154(b) by 0 days.

(21) Appl. No.: 13/028,032

(22) Filed: Feb. 15, 2011

(65) Prior Publication Data

US 2012/0204505 A1 Aug. 16, 2012

(51) Int. Cl.
*E06B 7/14* (2006.01)

(52) U.S. Cl. ..... 52/209; 52/204.5

(58) Field of Classification Search ..... 52/209, 52/204.5, 204.52, 204.51, 208, 204.53, 204.59, 52/204.591
See application file for complete search history.

(56) References Cited

U.S. PATENT DOCUMENTS

| | | | | |
|---|---|---|---|---|
| 4,154,033 | A * | 5/1979 | Krueger et al. | 52/209 |
| 4,156,988 | A | 6/1979 | Grover et al. | |
| 4,387,542 | A * | 6/1983 | Wehr | 52/209 |
| 4,715,152 | A | 12/1987 | Tanikawa | |
| 4,843,787 | A | 7/1989 | Pierson | |
| 4,984,402 | A | 1/1991 | Davies | |
| 5,038,537 | A * | 8/1991 | Frambach | 52/207 |
| 5,044,121 | A | 9/1991 | Harbom et al. | |
| 5,086,596 | A * | 2/1992 | Schlyper et al. | 52/204.52 |
| 5,123,212 | A | 6/1992 | Dallaire et al. | |
| 5,560,149 | A * | 10/1996 | Lafevre | 49/501 |
| 5,822,933 | A | 10/1998 | Burroughs et al. | |
| 5,887,387 | A | 3/1999 | Dallaire | |
| 5,921,038 | A | 7/1999 | Burroughs et al. | |
| 6,098,343 | A | 8/2000 | Brown et al. | |
| 6,170,207 | B1 | 1/2001 | Saindon | |
| 6,385,925 | B1 * | 5/2002 | Wark | 52/209 |
| 6,427,397 | B1 * | 8/2002 | Kolaschnik | 52/204.5 |
| 6,883,279 | B2 | 4/2005 | Fukuro et al. | |
| 7,222,462 | B2 | 5/2007 | Ellingson | |
| 7,347,155 | B2 | 3/2008 | D'Eon | |
| 7,574,829 | B1 * | 8/2009 | Prager | 49/408 |
| 7,730,679 | B2 | 6/2010 | Eckenswiller et al. | |
| 2003/0177699 | A1 * | 9/2003 | Fukuro et al. | 49/408 |
| 2005/0055912 | A1 | 3/2005 | Teodorovich | |
| 2005/0060940 | A1 | 3/2005 | Alexander et al. | |
| 2006/0236618 | A1 | 10/2006 | Williams | |
| 2008/0196342 | A1 * | 8/2008 | Franklin | 52/309.1 |
| 2008/0307715 | A1 | 12/2008 | Pufahl | |
| 2009/0007497 | A1 | 1/2009 | Sawada | |
| 2009/0007505 | A1 | 1/2009 | Sawada | |
| 2009/0272045 | A1 | 11/2009 | Teodorovich | |

* cited by examiner

*Primary Examiner* — Mark Wendell
(74) *Attorney, Agent, or Firm* — Rathe Lindenbaum LLP

(57) ABSTRACT

One embodiment of the invention relates to an apparatus for a window frame. The apparatus includes a window frame having a lower frame portion; a window glazing supported by the lower frame portion; a glazing bead; and at least two connectors operatively connecting the glazing bead to the lower frame. The connectors are spaced apart defining a fluid pathway allowing fluid to escape from the lower frame.

20 Claims, 4 Drawing Sheets

WINDOW FRAME WITH HIDDEN WEEP

CROSS-REFERENCE TO RELATED PATENT APPLICATIONS

None.

BACKGROUND

The present disclosure relates generally to the field of window construction. Some window designs include a frame that houses the glazing of the window and a glazing bead that couples to the frame to enclose the glazing and provide decorative features. When the window is installed in a building, the outer glazing bead faces the exterior of the building. Water or other fluids or debris may collect in interior spaces of the frame between the frame, glazing, and glazing bead. It would be advantageous to provide drainage for a window frame with inconspicuous outlets.

SUMMARY

One embodiment of the invention relates to an apparatus for a window frame. The apparatus includes a window frame having a lower frame portion; a window glazing supported by the lower frame portion; a glazing bead; and at least two connectors operatively connecting the glazing bead to the lower frame. The connectors are spaced apart defining a fluid pathway allowing fluid to escape from the lower frame.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Figure 1:
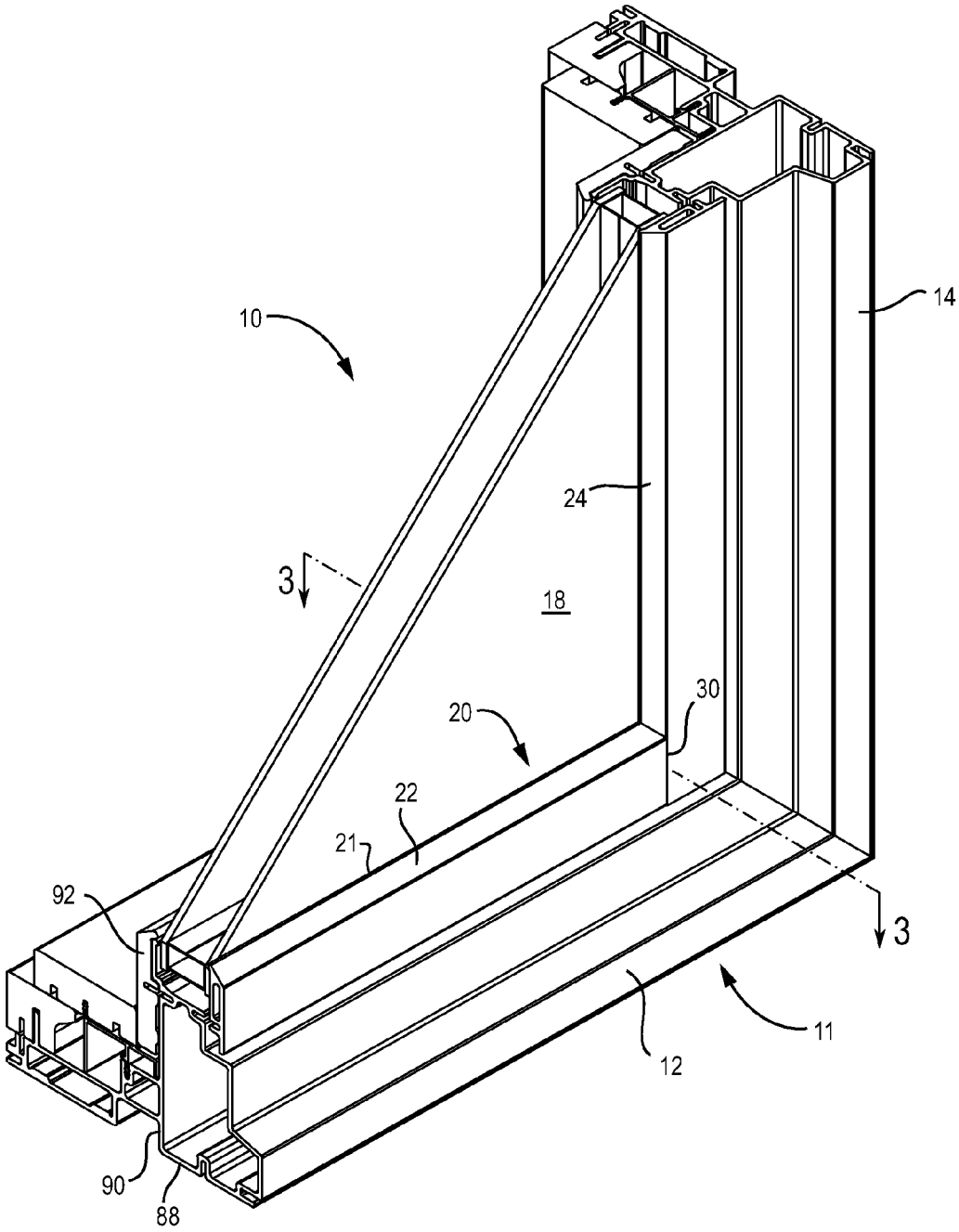
FIG. 1 is an isometric section view of a window, according to an exemplary embodiment.

Referring to FIG. 1, a window 10 includes a frame 11 surrounding at least one pane of glazing or glass 18. Window 10 will be described herein as a generally rectangular frame including a lower frame portion 12 and a side frame portion 14 that is angled relative to lower frame portion 12. Window 10 may further include a second side frame portion and an upper frame portion, not shown in FIG. 1. According to a preferred embodiment, window 10 is a rectangular body with a horizontal lower frame portion 12, a horizontal upper frame portion, and two vertical side frame portions 14.

Lower frame portion 12 and side frame portion 14 may be made of wood, a vinyl material, a composite material, a plastic material, an aluminum material, a steel material, an combination thereof, or any other material suitable for a window. As shown in FIG. 1, according to one embodiment, the components of frame are formed with an extrusion process from a suitable material such as a metal (e.g., aluminum, etc.) or a polymer (e.g., vinyl, etc.).

According to various exemplary embodiments, glazing 18 may include a single pane of glass, double panes of glass, triple panes of glass or any other number of panes. Any space between multiple panes of glass 18 may be filled with air, argon, krypton, a vacuum, or any other substance. Glazing 18 may be made of any type of glass material (e.g., soda lime glass, alkali silicate glass, etc.) of any thickness and may include any features of past, present, or future design (e.g., a low-E coating, lamination, tinting, impact resistance, shatter resistance, etc.) Glazing 18 may also be formed of any other type of window material such as plastic.

A glazing bead 20 is coupled to frame 11 around the periphery of glazing 18. Glazing bead 20 is configured to secure glazing 18 in frame 11 and may also be designed as a decorative trim element to provide a pleasing appearance. Glazing bead 20 may be formed from a material used to form frame 11 such as wood, a vinyl material, a composite material, a plastic material, an aluminum material, a steel material, a combination thereof, or any other suitable material.

According to an exemplary embodiment, glazing bead 20 may include a flexible lip 21 to create a better seal against the surface of glazing 18. Flexible lip 21 may be formed of the same material as the main body of glazing bead 20 and be flexible because of a reduced thickness or may be a different material that is coextruded, applied as a coating, or otherwise coupled to the main body of glazing bead 20.

Glazing bead 20 may comprise several individual elements or may be a single, continuous element that is shaped (e.g., by bending) to extend about the periphery of glazing 18. Referring to the exploded view in FIG. 2, according to one exemplary embodiment, glazing bead 20 includes a lower glazing bead 22 and a side glazing bead 24. Similar to frame 11, glazing bead 20 further includes a second side glazing bead and an upper glazing bead not shown.

Figure 2:
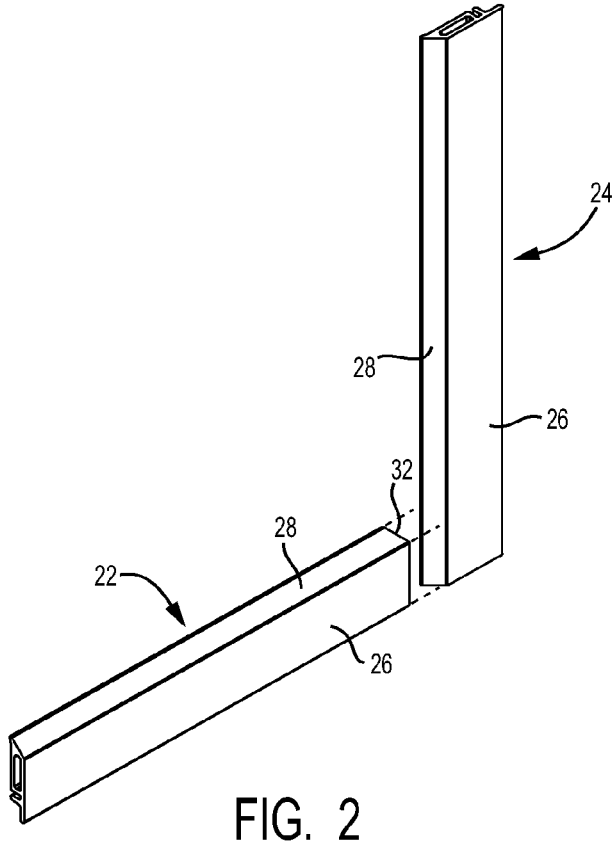
FIG. 2 is an exploded view of the glazing bead for the window of FIG. 1.
Figure 3:
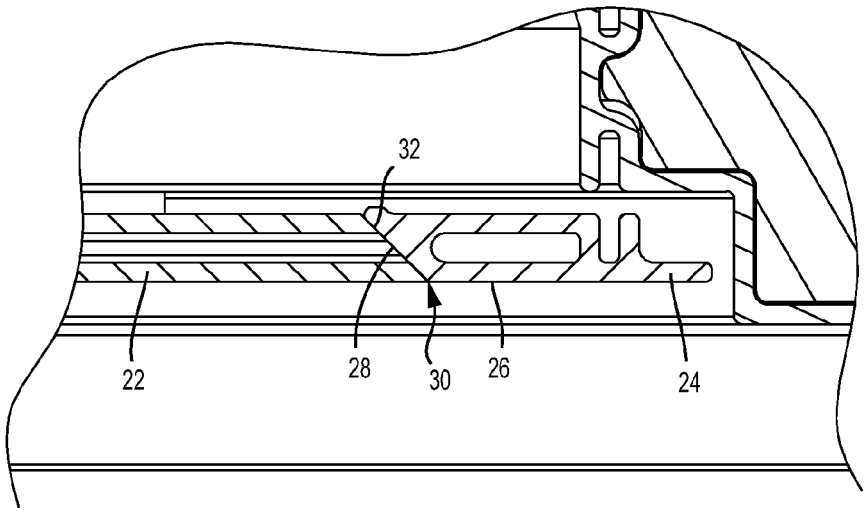
FIG. 3 is a section view of the window of FIG. 1, taken generally along line 3-3 in FIG. 1.

Referring still to FIGS. 1-3, glazing bead 20 includes a front surface 26 (e.g., first surface, vertical surface, etc.) and a beveled surface 28 (e.g., second surface, angled surface, etc.). According to an exemplary embodiment, lower glazing bead 22 and side glazing bead 24 are coupled together to form a faux-butt joint 30. Faux-butt joint 30 appears to an observer to be a butt joint (e.g., a joint with the components meeting at a face normal to the front face), however, referring to FIG. 3, lower glazing bead 22 includes an angled cut 32 that is configured to mate with beveled surface 28 of side glazing bead 24. Coupling lower glazing bead 22 and side glazing bead 24 along the angled mating surface between angled cut 32 and beveled surface 28 facilitates forming a better seal by increasing the area of contact between lower glazing bead 22 and side glazing bead 24.

Figure 4:
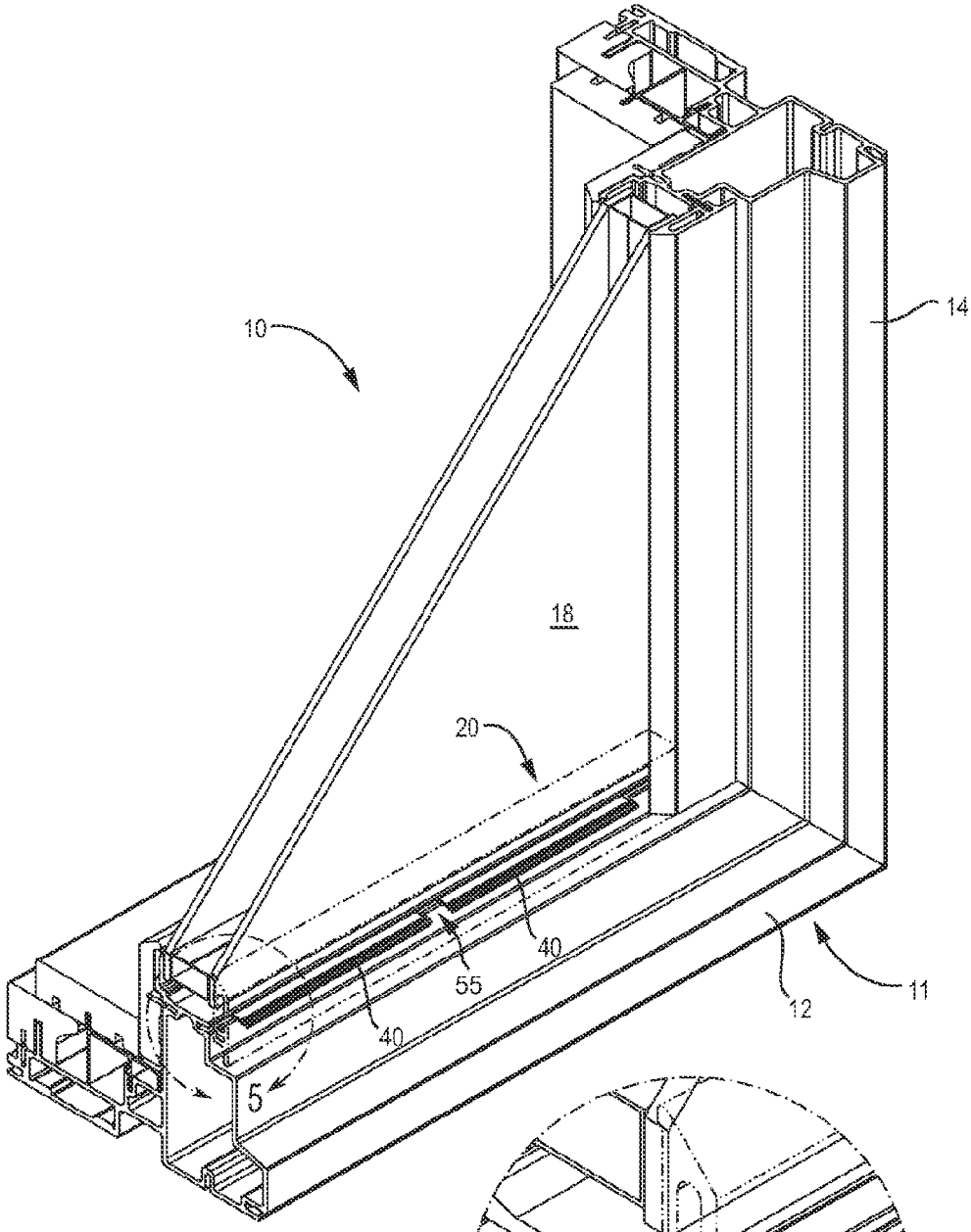
FIG. 4 is an isometric section view of the window of FIG. 1 with a portion of the glazing bead removed.
Figure 5:
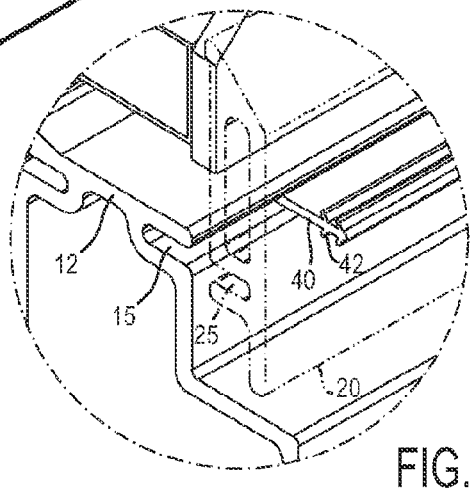
FIG. 5 is a detailed isometric view of the window of FIG. 2, taken generally along line 5-5 in FIG. 4.
Figure 6:
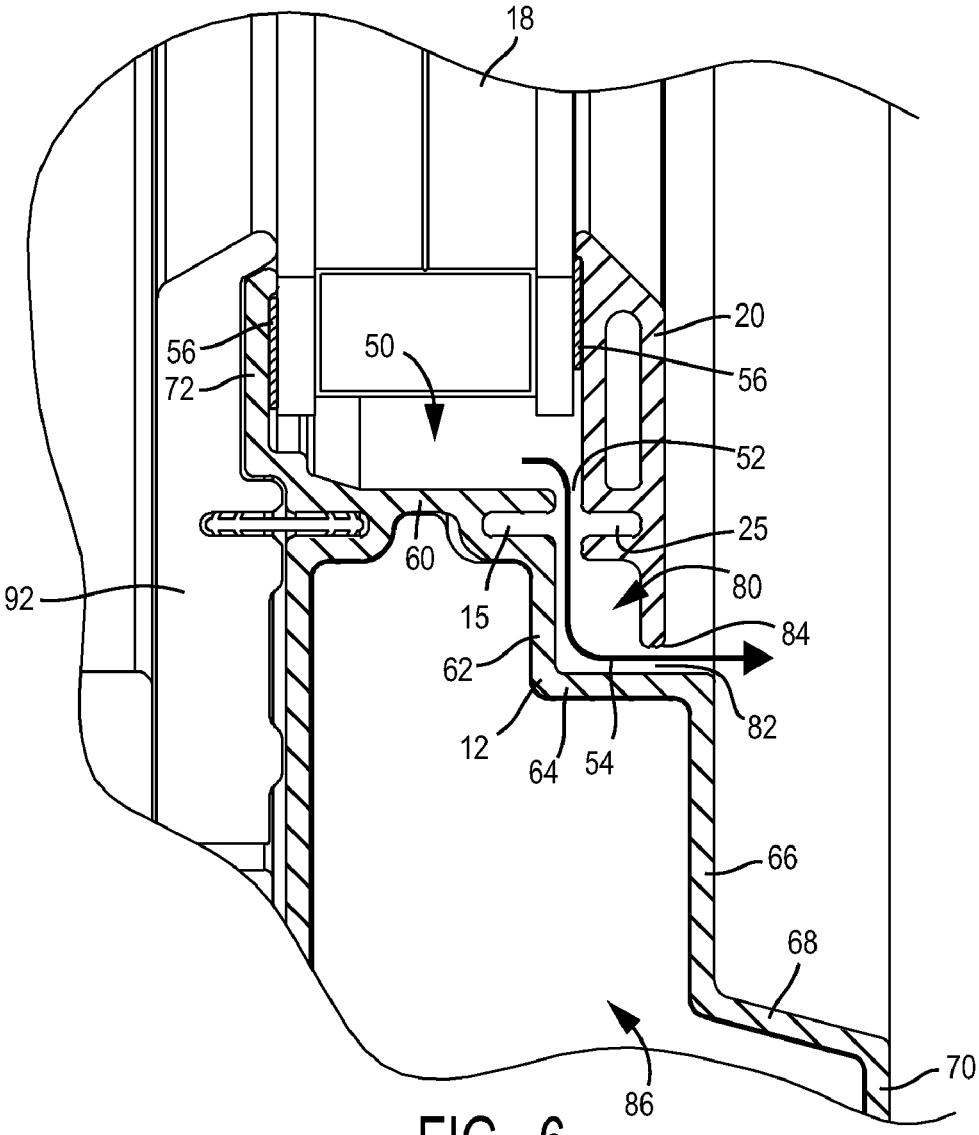
FIG. 6 is a left side view of the window of FIG. 1.

Referring now to FIG. 4, connectors 40 are provided to couple glazing bead 20 to frame 11. Connectors 40 are generally flat, elongated members that are received in a slot 15 in frame 11 and a slot 25 in glazing bead 20. In one embodiment connectors 40 are continuous along the upper frame portion and side frame portions 14. The continuous connectors 40 secured to the upper frame portion and side frame portions connect the glazing bead 20 and connect on the upper frame portion and side frame portions provide a water shed or seal to prevent leaks. However, in one embodiment multiple connectors 40 may be used along the bottom of lower frame portion 12. The length, number, and spacing of connectors 40 may be varied based on the requirements of frame (e.g., the force needed to retain glazing 18, etc.). The spacing between connectors 40 along the lower frame portion 12 on the exterior provides the route through which fluid may exit. Connectors 40 are also provided to couple an interior covering 92 to an interior surface of the frame. Note that connectors 40 on the lower frame portion 12 on the interior side of the frame that connect covering 92 provide spacing 55. Referring to FIG. 4-FIG. 6 connectors 40 are separated by a space 55 along a linear axis being parallel to a plane defined by the window glazing 18. A continuous connector 40 may be used on the interior lower frame portion 12 to connect covering 92. Interior covering 92 may be formed of wood, wood composite, plastic, fiberglass, vinyl or other decorative covering material.

Referring to FIG. 5, a portion of window 10 is illustrated in greater detail, according to an exemplary embodiment. Connector 40 is configured for mating with frame 11 and glazing bead 20 with one or more barbs 42. Either end of connector 40 includes multiple flexible barbs 42 (e.g., flaps, protrusions, fins, etc.) to aid in mating with frame 11 and glazing bead 20. Barbs 42 may extend from either or both faces of connector 40. As shown, barbs 42 are angled away from the distal edges of connector 40 relative to the main body of connector 40.

Slots 15 and 25 are sized such that barbs 42 are compressed and otherwise deformed when connector 40 is inserted into slot 15 and/or slot 25. The distortion of barbs 42 when connector 40 is inserted into slots 15 and 25 is resisted by an outward biasing force. The outward force provided by barbs 42 retains connector 40 in slots 15 and 25 and therefore couples glazing bead 20 to frame 11 and to secure glazing 18 in frame 11. The retaining force of barbs 42 is sufficient to overcome opposing forces such as the weight of glazing bead 20, wind, rain, etc. However, the retain force provided by barbs 42 can be overcome by a sufficient outward force, allowing glazing bead 20 to be removed for maintenance or replacement.

While barbs 42 are shown as being generally planar members of a single size and relative orientation, many variations are possible while still providing sufficient force for coupling frame 11 and glazing bead 20. For example, instead of a continuous body extending the length of connector 40, barb 42 may comprise several discrete elements. Barbs 42 may be oriented at a different angle or may have a different cross-sectional shape (e.g., triangular, rounded, etc.). Barbs 42 may vary in size on either side of connector to mate with slots of different sizes in frame 11 and glazing bead 20. Further, barbs 42 may vary in size between the top and bottom faces of connector 40.

The main body of connector 40 and barbs 42 may be made of different materials and integrally formed with a suitable process such as coextrusion. According to various exemplary embodiments, barbs 42 may be made of flexible polyvinyl chloride (PVC), thermoplastic elastomer (TPE), flexible urethane, a rubber based material, or a similar flexible extruded material. According to various exemplary embodiments, connector 40 may be made of PVC, polypropylene, acrylonitrile butadiene styrene (ABS), or any other rigid extrudable material.

Referring now to FIG. 6, an end view window 10 is shown according to an exemplary embodiment, showing the structure below glazing 18. Lower frame portion 12 may be a substantially hollow body (e.g., formed as an extruded aluminum or vinyl body, etc.) defined at least partially by an top face 60, a first wall 62, a first shelf 64, a second wall 66, a second shelf 68, and a third wall 70. Lower frame portion may further include an interior wall 72 extending along the inside face of glazing 18. Wall 72 provides a physical stop that helps to secure and locate glazing 18 in frame 11.

Glazing 18 is generally supported above top face 60 of lower frame portion 12 with support structures or spacers. Below the lower edge of glazing 18 is formed an open volume 50 (e.g., space, chamber, cavity, etc.), which is substantially enclosed by lower frame portion 12 and glazing bead 20. Volume 50 is generally defined by glazing 18, glazing bead 20 and top face 60 and wall 72 of lower frame portion 12.

While the seal formed around glazing 18 by glazing bead 20 prevents the majority of water from passing through, moisture may still enter volume 50. For example, moist air may enter volume 50, allowing water to condense in volume 50. A glazing compound 56 is placed between glazing bead 20 and glazing 18 to secure glazing bead 20 to glazing 18. Glazing compound may include other materials and/or tape known in the art including but not limited to silicon compound, one hundred percent silicon, or a hot melt material. Wall 72 prevents water from flowing out of volume 50 into the interior space of the building or enclosure including window 10. Glazing compound 56 is also located between wall 72 and glazing 18. Glazing compound 56 assists in keeping water from entering the interior of the structure as well as from entering the interior of frame regions 50 and 86.

To allow water, other fluids, or debris to exit volume 50, flow paths 54 are formed by the components of window 10. Flow paths 54 are formed by the arrangement of lower frame portion 12, glazing bead 20, and connectors 40 and does not require any additional openings (e.g., channels, holes, slots, etc.) to be formed in components. The weep or exit of flow paths 54 is provided inconspicuously between the lower edge 84 of glazing bead 20 and lower frame portion 12.

According to an exemplary embodiment, flow path 54 is formed between glazing bead 20 and lower frame portion 12. Connectors 40 couple glazing bead 20 to lower frame portion 12 such that glazing bead 20 creates a seal against glazing 18 while maintaining a separation 52 from first wall 62 of lower frame portion 12. Referring to FIG. 4, instead of a single component extending the entire length of lower frame portion 12, connectors 40 are provided as multiple, separate components separated by gaps 56. Flow path 54 extends between glazing bead 20 and lower frame portion 12 through gaps 56 between connectors 40.

A second volume 80 is formed between lower frame portion 12 and glazing bead 20 below first volume 50. Volume 80 is generally defined by first wall 62 and first shelf 64 of lower frame portion 12 and glazing bead 20. After flowing out of volume 50, fluids and debris enter volume 80. Glazing bead 20 is coupled to lower frame portion 12 by connectors 40 such that a gap 82 is formed between the lower edge 84 of glazing bead 20 and first shelf 66 of lower frame portion 12. Gap 82 is the only portion of flow path 54 that is visible when window 10 is assembled and installed.

Flow path 54 directs fluids and debris out of the interior of window 10 without entering lower frame portion 12. Fluids and debris are allowed to escape volume 80 through gap 62, flow down second wall 66 of lower frame portion 12, over second shelf 68, down a third wall 70, and escape into the exterior environment. Top face 60, first shelf 64, and second shelf 68 of lower frame portion 12 may be pitched or angled to facilitate the flow of fluids and debris to the exterior space.

Volumes 50 and 80 and flow paths 54 direct any fluids or debris that may collect in the interior of window 10 to the exterior space, reducing the likelihood of damage to window 10 caused by the fluids or debris (e.g., by expansion of freezing water, etc.). The formation of flow paths 54 by the arrangement of components is advantageous because openings formed in components can be obstructed by debris, reducing the ability of fluids to escape volume 50. Further, openings formed in components of window 10 to create flow paths may require additional manufacturing steps (e.g., machining, stamping, etc.), increasing manufacturing time and cost of window 10.

A third volume 86 is located below first volume 50 and second volume 80 and is sealed such that no water is permitted to enter into volume 86. Third volume 86 is formed by top face 60, first wall 62, first shelf 64, a second wall 66, a second shelf 68, a third wall 70, a bottom wall 88 and a fourth wall 90.

For purposes of this disclosure, the term "coupled" means the joining of two components directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature.

While window 10 is described as rectangular body, in other exemplary embodiments, window 10 and glazing 18 may differently shaped and still include construction that provides an inconspicuous weep. For example, window 10 may be square, another polygonal shape (e.g., hexagonal, octagonal, etc) or rounded. Regardless of the overall shape of window 10, the lower portion of frame 11 and glazing bead 20 may be arranged such flow paths are formed to allow fluids and debris to flow out of the lower portion of window 10.

The arrangement and construction of the frame members and glazing bead for window 10 provides an inconspicuous weep that can be adapted to many other styles of windows. While window 10 is shown in the FIGURES as a picture window frame, in other embodiments, window 10 may be of another construction, such as a casement window, a double hung window, or a bay window.

The present disclosure has been described with reference to exemplary embodiments, however, workers skilled in the art will recognize that changes may be made in form and detail without departing from the spirit and scope of the disclosure. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements.

It is also important to note that the construction and arrangement of the elements of the system as shown in the exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Further, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the exemplary embodiments without departing from the spirit of the present subject matter.

What is claimed is:

1. An apparatus for a window frame, comprising:
a window frame having a lower frame portion;
a window glazing supported by the lower frame portion;
a glazing bead; and
at least two separate connectors operatively connecting the glazing bead to the lower frame along a linear axis being parallel to a plane defined by the window glazing;
wherein the connectors are spaced apart from one another along the linear axis defining a fluid pathway between the spaced connectors allowing fluid to escape from the lower frame.

2. The apparatus of claim 1, wherein a first volume is defined by the window glazing, the lower frame, and the glazing bead.

3. The apparatus of claim 2, wherein a second volume is defined by the lower frame and the glazing bead.

4. The apparatus of claim 3, wherein the connectors are provided between the first volume and the second volume.

5. An apparatus for a window frame, comprising:
a window frame having a lower frame portion;
a window glazing supported by the lower frame portion;
a glazing bead; and
at least two separate connectors operatively connecting the glazing bead to the lower frame, the connectors being spaced apart defining a fluid pathway allowing fluid to escape from the lower frame, a first volume being defined by the window glazing, the lower frame, and the glazing bead and a second volume being defined by the lower frame and the glazing bead, the connectors are provided between the first volume and the second volume;
wherein the fluid pathway operatively connects the first volume in fluid communication with the second volume, permitting fluid to flow from the first volume to the second volume.

6. The apparatus of claim 5, wherein the second volume is in fluid communication with the exterior through a gap is formed between the lower edge of the glazing bead and the lower frame.

7. The apparatus of claim 1, wherein the lower frame includes a third hollow region located below the first volume and second volume, the fluid pathway being external to the third hollow region.

8. A window apparatus, comprising:
a window frame having a lower frame portion;
a window glazing operatively supported by the lower frame portion, a first volume defined between a bottom edge of the window glazing and the lower frame portion;
a glazing bead having an exterior surface, an opposing interior surface and a lower edge; and
at least two separate spaced apart connectors operatively connecting the glazing bead to the lower frame portion, each connector extending substantially horizontally and having a first end removably received within a groove extending into the interior surface of the glazing bead and a second end being removably received within a groove in the lower frame portion;

the first volume is in fluid communication with the exterior of the window through a fluid pathway defined by a space between the connectors and a gap between the lower edge of the glazing bead and the lower frame portion.

9. The apparatus of claim 8, wherein a first volume is defined by the window glazing, the lower frame, and the glazing bead.

10. The apparatus of claim 9, wherein a second volume is defined by the lower frame and the glazing bead.

11. The apparatus of claim 10, wherein connectors are provided between the first volume and the second volume.

12. The apparatus of claim 11, wherein the connectors are oriented horizontally.

13. The apparatus of claim 11, wherein the fluid pathway operatively connects the first volume in fluid communication with the second volume, permitting fluid to flow from the first volume to the second volume.

14. The apparatus of claim 13, wherein the second volume is in fluid communication with the exterior through a gap is formed between the lower edge of the glazing bead and the lower frame.

15. The apparatus of claim 14, wherein the lower frame includes a third hollow region located below the first volume and second volume, the fluid pathway being external to the third hollow region.

16. A window, comprising:

a window frame having a lower frame portion;

a window glazing operatively by the lower frame portion, a first volume defined between a bottom edge of the window glazing and the lower frame portion;

a glazing bead having an exterior surface, an opposing interior surface and a lower edge; and the window frame having a second volume defined by an upper wall, a first side wall and a second side wall, the second volume not in fluid communication with the first volume, the first side wall having a shelf portion extending outwardly below the lower surface of the glazing bead;

the first volume being in fluid communication with the exterior of the window through a fluid pathway defined by a gap between the lower edge of the glazing bead and the outwardly extending portion of the first side wall of the lower frame portion.

17. The apparatus of claim 16 further including at least two separate spaced apart connectors operatively connecting the glazing bead to the lower frame portion, each connector extending substantially horizontally and having a first end removably received within a groove extending into the interior surface of the glazing bead and a second end being removably received within a groove in the lower frame portion.

18. The apparatus of claim 16, wherein the first side wall includes a first substantially vertical side wall portion extending between and connecting the upper wall and shelf portion, a third volume is defined by the first substantially vertical side wall portion, glazing bead and shelf portion, the third volume being in fluid communication with the first volume and hermetically sealed from the second volume.

19. The apparatus of claim 18 further including a first connector removably securing the glazing bead to the lower frame portion.

20. The apparatus of claim 19, further including at least a second connector spaced apart from the first connector and operatively connecting the glazing bead to the lower frame portion, each connector extending substantially horizontally and having a first end removably received within a groove extending into the interior surface of the glazing bead and a second end being removably received within a groove in the lower frame portion.

* * * * *